US010518156B2

(12) United States Patent
Evans et al.

(10) Patent No.: US 10,518,156 B2
(45) Date of Patent: Dec. 31, 2019

(54) KICKBOARD TRAINING DEVICE

(71) Applicant: Sports Engineering Group, LLC, Council Bluffs, IA (US)

(72) Inventors: Marc P. Evans, Council Bluffs, IA (US); Jane M. Cappaert, Council Bluffs, IA (US)

(73) Assignee: Sports Engineering Group, LLC, Council Bluffs, IA (US)

( * ) Notice: Subject to any disclaimer, the term of this patent is extended or adjusted under 35 U.S.C. 154(b) by 0 days.

(21) Appl. No.: 15/788,413

(22) Filed: Oct. 19, 2017

(65) Prior Publication Data

US 2018/0133574 A1 May 17, 2018

Related U.S. Application Data

(60) Provisional application No. 62/410,304, filed on Oct. 19, 2016.

(51) Int. Cl.
*A63B 69/14* (2006.01)
*A63B 31/12* (2006.01)

(52) U.S. Cl.
CPC ..... *A63B 69/14* (2013.01); *A63B 31/12* (2013.01); *A63B 2225/605* (2013.01)

(58) Field of Classification Search
CPC ..... A63B 69/14; A63B 31/12
USPC ..... 441/65
See application file for complete search history.

(56) References Cited

U.S. PATENT DOCUMENTS

| | | | |
|---|---|---|---|
| 183,045 | A | 10/1876 | Dunlop |
| 950,633 | A | 3/1910 | Eastman |
| 1,971,844 | A | 8/1934 | Jackson |
| 3,417,415 | A | 12/1968 | John |
| RE28,855 | E | 6/1976 | Montrella |
| D262,477 | S | 12/1981 | Lewis |
| 4,316,300 | A | 2/1982 | Lewis |
| 4,721,300 | A | 1/1988 | Guzman |
| 4,913,418 | A | 4/1990 | Schlueter et al. |
| 5,147,233 | A | 9/1992 | Hannula |
| 5,288,254 | A | 2/1994 | Elson |
| 5,304,080 | A | 4/1994 | Dilger |
| 5,376,036 | A | 12/1994 | Hull |
| D363,754 | S | 10/1995 | Johnson |

(Continued)

OTHER PUBLICATIONS

Author Unknown, "Strokemakers" Speedshop Int'l, Inc., Feb. 2, 1996, 2 pages.

(Continued)

*Primary Examiner* — Stephen P Avila
(74) *Attorney, Agent, or Firm* — Dorsey & Whitney LLP

(57) ABSTRACT

A kickboard training device is provided. The kickboard may include an upper surface, a lower surface, and front, rear, left, and right edges bounding the upper and lower surfaces. The kickboard may include opposing wing portions positioned across a longitudinal centerline extending between the front and rear edges. The kickboard may include one or more surface elements associated with at least one of the upper and lower surfaces. The one or more surface elements may be arranged to define a flotation characteristic of the kickboard. The one or more surface elements may include at least one of a channel defined in at least the upper surface, a plurality of grooves defined in at least the lower surface, and one or more ailerons coupled to the kickboard.

16 Claims, 5 Drawing Sheets

(56) References Cited

U.S. PATENT DOCUMENTS

| | | | | |
|---|---|---|---|---|
| 5,634,834 | A * | 6/1997 | Cole | A63B 69/14 441/65 |
| 5,643,027 | A | 7/1997 | Evans et al. | |
| 5,810,630 | A * | 9/1998 | Saghri | B63B 35/7906 440/9 |
| 7,798,876 | B2 * | 9/2010 | Mix | A63B 69/14 441/65 |
| 9,308,418 | B2 | 4/2016 | Davis et al. | |
| 2014/0141667 | A1 * | 5/2014 | DiLorenzo | B63B 35/7906 441/74 |
| 2016/0107731 | A1 * | 4/2016 | Chen | B63B 35/7926 441/66 |

OTHER PUBLICATIONS

Author Unknown, "CatalystTM Advertisement", TYR Sport, Huntington Beach, CA 92649, Jan. 1996, 3 pages.

Cappaert, et al., "Three-Dimensional Analysis of the Men's 100-m Freestyle During the 1992 Olympic Games", Journal of Applied Biomechanics; Human Kinetics Publishers, Inc., vol. 11, No. 1, Feb. 1995, pp. 103-112.

Donaldson, "A Sailor's Guide to Sails", Dodd, Mead & Company, 79 Madison Avenue, New York, NY 10016, 1984, pp. 4-7 and 36-41.

Hannula, "Effective Paddle Training", Source Unknown, May 1992, 5 pages.

Hannula, "Han's Paddles Brochure", Tacoma, WA, Feb. 2, 1996, 2 pages.

Hull, "Fulcrum High Speed Pull Paddles", Zoomers, Woodside CA, 1990, 3 pages.

Schleihauf, et al., "Propulsive Techniques: Front Crawl Stroke, Butterfly, Backstroke, and Breaststroke", Swimming Science V, International Series of Sport Sciences, vol. 18, 1988, pp. 53-59.

Smith, "The Illustrated Guide to Aerodynamics", Tab Books Inc., Blue Ridge Summit, PA, 1985, pp. 10-29 and 44-45.

U.S. Appl. No. 29/581,522, filed Oct. 19, 2016.

U.S. Appl. No. 15/788,422, filed Oct. 19, 2017.

* cited by examiner

KICKBOARD TRAINING DEVICE

CROSS REFERENCE TO RELATED APPLICATIONS

This application claims the benefit of priority under 35 USC § 119(e) of the earlier filing date of U.S. Provisional Patent Application No. 62/410,304 filed Oct. 19, 2016 and entitled "KICKBOARD TRAINING DEVICE," which is hereby incorporated by reference in its entirety.

TECHNICAL FIELD

The present disclosure relates generally to physical fitness, skill, and technique development and training and more specifically to a kickboard training device.

BACKGROUND

Various devices and systems exist to perform a variety of swimming exercises. As an example, kickboards exist to work the cardiovascular system, strength, endurance, and/or isolating the kick and swim technique of a swim athlete as part of a swimming program. Utilizing a kickboard may isolate the feet, legs, and pelvis from the other technical swimming skills, thus allowing a swimmer to increase their focus on kicking form and performance, for instance. Many currently available kickboards, however, generally have undesirable buoyancy and/or drag effect because of the shape and/or materials that are utilized. Some kickboards may place a swimmer in a compromised swimming position, such as in an undesirable or unnatural biomechanical position. For example, because of their high buoyancy, some kickboards may place a swimmer in a non-horizontal, non-streamlined swimming position, thereby hindering the training of proper swimming form. In addition, a more vertical body position can decrease pelvic load transfer and/or increase body drag through the water, thus limiting the transfer of force to a swimmer's limbs and/or forward propulsion, respectively. Traditional kickboards may hinder posture, reduce efficiency, and/or create biomechanical issues or problems, such as for swimmers with neck, back, or shoulder problems, as the kickboard's tendency to elevate the upper body relative the trunk or torso of a swimmer can place increased strain on those areas. For example, traditional kickboards may cause undesirable extension, tension, or loading of the cervical, scapulohumeral, lumbar, and/or thoracic areas of a user's spine, among others. Some kickboards may also include a lack of specificity in terms of horizontal body posture as well as to how a swimmer's hand is to be attached to the board, which may limit the effectiveness of the kickboard as a training aid.

It is therefore desirable to provide an improved kickboard that addresses at least in part the above described problems and/or which more generally offers improvements or an alternative to existing arrangements.

SUMMARY

The present disclosure generally provides a kickboard training device. The kickboard is arranged to facilitate a desired or optimal load transfer, such as a pelvic load and energy transfer, to promote proper swimming form and/or technique. For example, the kickboard may be arranged to better transfer the load of muscular force from the pelvis to, for example, the legs, arms, chest, back, and shoulder areas of a swimmer, which may be desirable to increase efficiency and power of the swimmer for a particular swim stroke. In addition, the kickboard may be sized and shaped to position a user in a more desirable swimming position to promote proper kicking form, increase kicking power and efficiency as a result of proper pelvic load transfer, and/or reduce the stresses placed on the neck, spine, and shoulder regions of the user. For example, the kickboard may reduce cervical, scapulohumeral, lumbar, and/or thoracic spine tension by lowering the angle of the arms and shoulders while raising the height of the hips and legs compared to the water surface. The kickboard may be arranged to provide various amounts of flotation and/or buoyancy, and may be configured to traverse under, at, or on the surface of water. In some embodiments, the kickboard may be shaped arcuately to reduce drag and may include one or more surface features to stabilize the kickboard laterally and/or trim the kickboard forward and aft. In some examples, the kickboard may be adjustable to adapt to the needs of a swimmer's skill level and/or the swimming stroke being performed.

Embodiments of the present disclosure may include a kickboard. The kickboard may include an upper surface, a lower surface, front, rear, left, and right edges bounding the upper and lower surfaces, and a channel defined within the upper surface at least partially between the front and rear edges.

In some examples, the lower surface may include a plurality of grooves defined therein and extending from the front edge. Each of the plurality of grooves may extend from the front edge to one of the left and right edges.

In some examples, each of the front, rear, left, and right edges may be arcuately shaped.

In some examples, each of the front, rear, left, and right edges may include a concave edge portion. Each of the front and rear edges may include a plurality of concave edge portions.

In some examples, the channel may be defined centrally within the upper surface of the kickboard.

In some examples, the channel may terminate at a pocket including a depth extending between the front and rear edges.

In some examples, the rear edge may be angled towards the front edge between the upper and lower surfaces.

Embodiments of the present disclosure may include a kickboard. The kickboard may include opposing front and rear edges, a longitudinal centerline extending between the front and rear edges, and first and second wing portions positioned opposite each other across the longitudinal centerline. Each of the first and second wing portions may define a convex leading edge portion and a concave trailing edge portion.

In some examples, the trailing edge portions of the first and second wing portions may taper toward each other to adjacent the rear edge. The distance between the trailing edge portions of the first and second wing portions may increase to the rear edge.

In some examples, each of the first and second wing portions may include a hydrofoil design arranged to provide lift to the kickboard.

In some examples, the first and second wing portions may define the width of the kickboard. The first and second wing portions may define a maximum width of the kickboard within a front portion of the kickboard. The maximum width of the kickboard may be nearer the front edge than the rear edge.

In some examples, a first peak may be defined in the front edge and positioned at the longitudinal centerline. A second peak may be defined in the rear edge and positioned at the longitudinal centerline. The first and second peaks may extend away from each other.

In some examples, a channel may extend from the rear edge along a portion of the longitudinal centerline. The channel may terminate at a pocket including a depth extending along the longitudinal centerline.

In some examples, the kickboard may be substantially symmetrical across the longitudinal centerline.

Embodiments of the present disclosure may include a kickboard configured to traverse under the surface of water. The kickboard may include opposing upper and lower surfaces, a plurality of wings each including a hydrofoil design to provide a degree of hydrodynamic lift to the kickboard while traversing through water, and one or more surface elements associated with at least one of the upper and lower surfaces, the one or more surface elements arranged to define a flotation characteristic of the kickboard.

In some examples, the one or more surface elements may include at least one of a channel defined in the upper surface, a plurality of grooves defined laterally in the lower surface, and one or more ailerons coupled to the kickboard. The channel may be defined along a longitudinal centerline extending between front and rear edges of the kickboard. The channel may terminate at a pocket including a depth extending along the longitudinal centerline. Each of the plurality of grooves may provide an aileron effect on the kickboard to trim the kickboard during swim training. The one or more ailerons may be adjustable.

Additional embodiments and features are set forth in part in the description that follows, and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One skilled in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The description will be more fully understood with reference to the following figures in which components may not be drawn to scale, which are presented as various embodiments of the kickboard training device described herein and should not be construed as a complete depiction of the scope of the training device.

DETAILED DESCRIPTION

Figure 1:
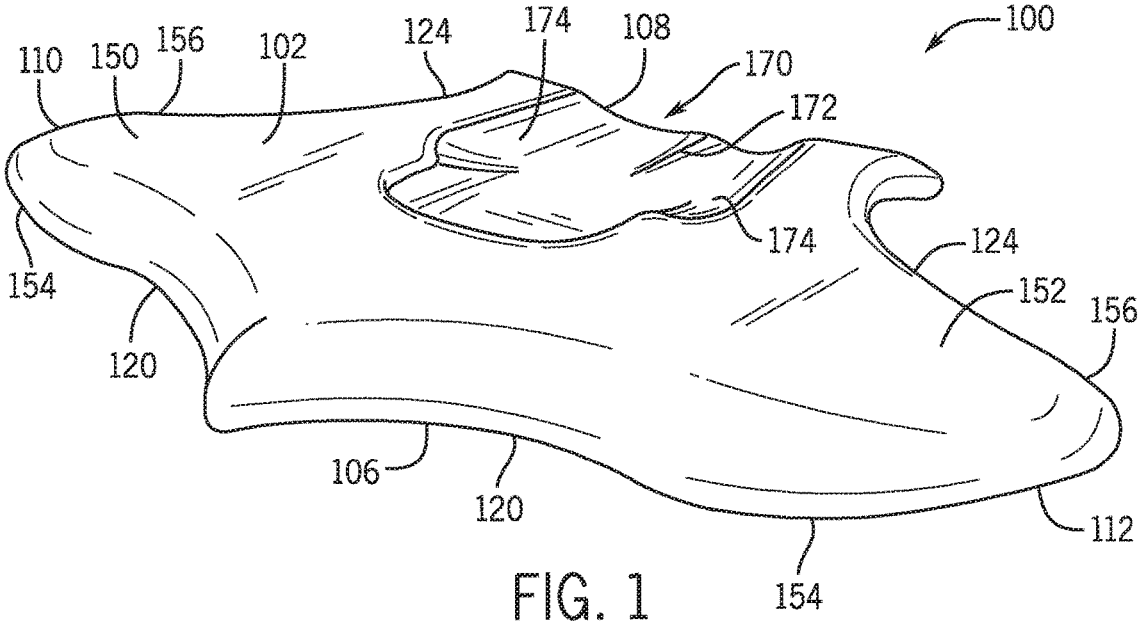
FIG. 1 is a top front isometric view of a kickboard.

FIGS. 1-7 illustrate an exemplary embodiment of a kickboard 100. As shown, the kickboard 100 may include an upper surface 102, a lower surface 104, and front, rear, left, and right edges 106, 108, 110, 112 bounding the upper and lower surfaces 102, 104. As explained below, the kickboard 100 may be sized and shaped for improved pelvic and deep core muscle load energy transfer and/or hydrodynamics, such as improved movement, stability, or the like of the kickboard 100 through fluid (e.g., water). As explained below, the kickboard 100 may be shaped and/or arranged for specific movement of the kickboard 100. For example, each of the front, rear, left, and right edges 106, 108, 110, 112 may be arcuately shaped to, for instance, improve the hydrodynamics of the kickboard 100, such as defining or shaping water flow adjacent or about the kickboard 100. The shape of the kickboard 100 may reduce the resistive forces and drag acting thereon to facilitate improvement of a user's speed, efficiency, and/or force generation.

Figure 2:
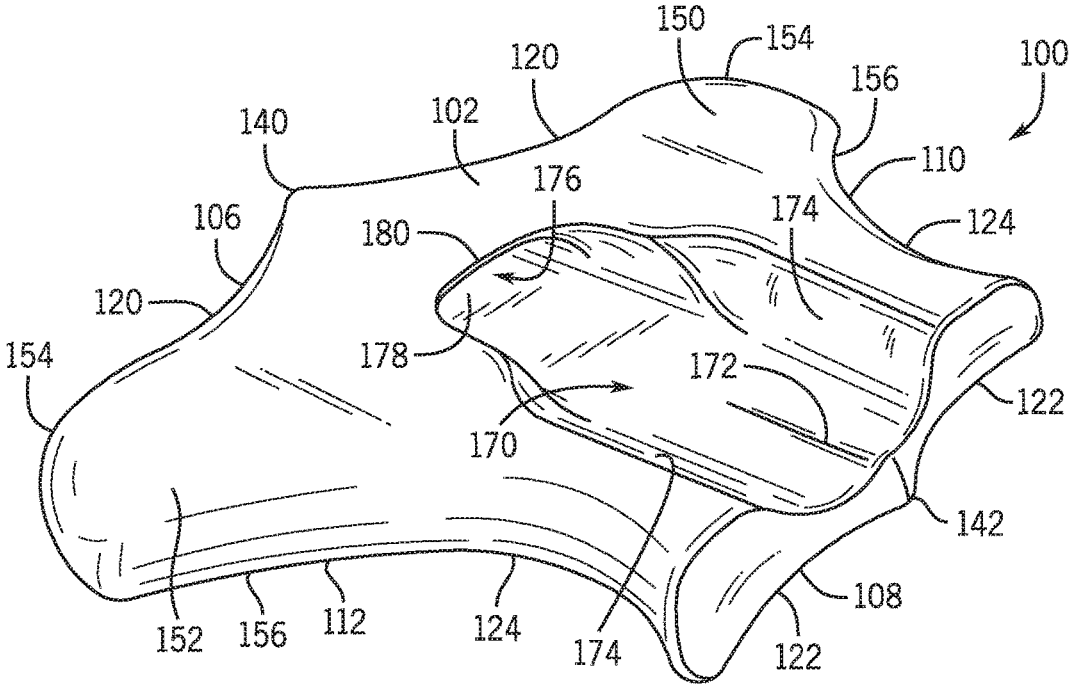
FIG. 2 is a top rear isometric view of the kickboard of FIG. 1.
Figure 4:
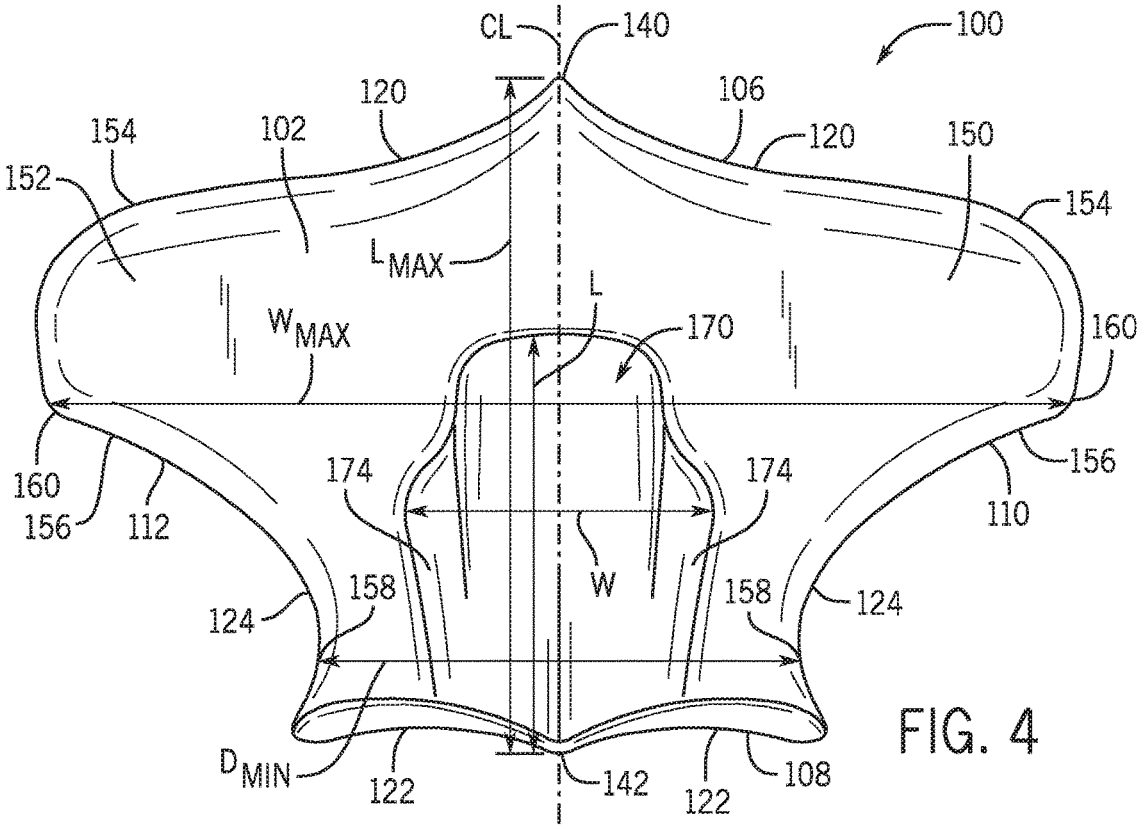
FIG. 4 is a top plan view of the kickboard of FIG. 1.

As shown in FIGS. 1, 2, and 4, each of the front, rear, left, and right edges 106, 108, 110, 112 may include a concave edge portion to at least define the flow of fluid over, under, or around the kickboard 100. In one embodiment, the front edge 106, which may be referred to as a leading edge, may be arcuately shaped for a streamlined shape from front to back. As shown, the front edge 106 includes a first plurality of concave edge portions 120 (e.g., two concave edge portions 120) to direct fluid flow around or adjacent the kickboard 100 during use. Similarly, the rear edge 108, which may be referred to as a trailing edge, may include a second plurality of concave edge portions 122 (e.g., two concave edge portions 122) to define the fluid flow behind the kickboard 100. The left and right edges 110, 112 may include a third plurality of concave edge portions 124 to further define the hydrodynamics of the kickboard 100. For example, the concave edge portions 122 of the rear edge 108 (and/or the concave edge portions 124 of the left and right edges 110, 112) may create one or more eddies behind the kickboard 100 to streamline the water flow around the kickboard 100 and around a user's body, thus reducing drag for the user while performing swim training exercises. To further reduce drag, for instance, the rear edge 108 may be chamfered or angled towards the front edge 106 from the lower surface 104 to the upper surface 102. As explained below, the concave edge portions 124 of the left and right edges 110, 112 may reduce the load or tension on the cervical, scapulohumeral, lumbar, and/or thoracic areas of a user's spine and other more distal body regions.

In the embodiments of FIGS. 2 and 4, a first peak 140 may be defined in the front edge 106 between adjacent concave edge portions 120. Similarly, a second peak 142 may be defined in the rear edge 108 between adjacent concave edge portions 122. As shown, the first and second peaks 140, 142 may be aligned along, such as positioned at, a longitudinal centerline CL of the kickboard 100, the longitudinal centerline CL extending between the front and rear edges 106, 108 (see FIG. 4). The first and second peaks 140, 142 may extend away from each other to streamline the kickboard 100, for instance. The first peak 140 may extend outwardly away from the kickboard 100 to define the concave edge portions 120 of the front edge 106 to direct fluid flow at least partially around the kickboard 100. The second peak 142 may extend outwardly away from the kickboard 100 to define the concave edge portions 122 of the rear edge 108 to define the flow of fluid behind the kickboard 100. As shown, the first and second peaks 140, 142 may define a maximum length $L_{MAX}$ of the kickboard 100, which in some embodiments may be between about 200 mm and about 350 mm (preferably about 275 mm). In some embodiments, the kickboard 100 may be sized and shaped depending on the particular age, skill level, or size, among others, of a user. For example, the kickboard 100 (e.g., the maximum length $L_{MAX}$) may be sized smaller for youth users compared to adult users, such as being about 25-50% smaller, about 50% smaller, greater than 50% smaller, or the like.

Referring to FIGS. 1, 2, and 4, the kickboard 100 may include first and second wing portions 150, 152 positioned opposite each other across the longitudinal centerline CL to define the width of the kickboard 100. Each of the first and second wing portions 150, 152 defines at least a portion of the front edge 106 and at least a portion of the opposing left and right edges 110, 112 of the kickboard 100. In some embodiments, the first and second wing portions 150, 152 may be mirror images of each other such that the kickboard 100 is substantially symmetrical across the longitudinal centerline CL (see FIG. 4). In such embodiments, each of the first and second wing portions 150, 152, which may be referred to as left and right wings or wing portions, may define a convex leading edge portion 154 and a concave trailing edge portion 156. In the embodiments of FIG. 4, the trailing edge portions 156 of the first and second wing portions 150, 152, which may at least partially define the concave edge portions 124 of the left and right edges 110, 112, taper toward each other to adjacent the rear edge 108 (e.g., to limit points 158 of the trailing edge portions 156 defining a minimum distance $D_{MIN}$ between the trailing edge portions 156). In such embodiments, the buoyancy of the kickboard 100 may vary from front to back due to the decreasing width, thus permitting the kickboard 100 to plane upwardly within or on the water. In this manner, the angle of the kickboard 100 relative a user's arms and/or body may reduce the load and/or tension on a user's shoulders, neck, upper back, etc., which may be desirable depending on the user's range of motion within those areas.

With continued reference to FIGS. 1, 2, and 4, the distance between the trailing edge portions 156 of the first and second wing portions 150, 152 may decrease linearly or non-linearly depending on the particular application. For example, as best shown in FIG. 4, the distance between the trailing edge portions 156 may decrease more rapidly with distance away from the rear edge 108. As shown, the curvature of the trailing edge portions 156 may be such that the distance between the trailing edge portions 156 increases from the limit points 158 to the rear edge 108. In such embodiments, the radius of curvature of the trailing edge portions 156 at the limit points 158 may be between about 40 mm and about 60 mm (preferably about 50 mm).

Depending on the particular application, the first and second wing portions 150, 152 may be arranged such that a maximum width $W_{MAX}$ of the kickboard 100 is nearer one of the front and rear edges 106, 108 (e.g., nearer the front edge 106 than the rear edge 108). In this manner, the first and second wing portions 150, 152 may be arranged adjacent the front edge 106 or the rear edge 108, as deep as ½ the length of the kickboard 100 between the front and rear edges 106, 108, more than ½ the length of the kickboard 100, or the like. As shown in FIG. 4, the maximum width $W_{MAX}$ may be defined at inflection points 160 defined between the concave leading edge portions 154 and the convex trailing edge portions 156 of the first and second wing portions 150, 152. The maximum width $W_{MAX}$ may be associated with the biacromial distance or breadth of the user. For instance, the kickboard 100 may be sized and shaped to correspond to the relative size of the user, such as being wider for an adult user and narrower for a youth user. Accordingly, the maximum width $W_{MAX}$ may be between about 200 mm and about 600 mm (preferably about 415 mm for an adult user and preferably about 300 mm for a youth user). The other dimensions of the kickboard 100, such as the maximum length $L_{MAX}$, may be configured similarly.

In the embodiments described herein, the first and second wing portions 150, 152 may be arranged to provide a desired stability and/or flotation characteristic to perform various swim training exercises. For instance, the width of the kickboard 100 as defined by the first and second wing portions 150, 152 may be sufficient to limit rotation of the kickboard 100 about its longitudinal centerline CL. Additionally or alternatively, each of the first and second wing portions 150, 152 may include a hydrofoil design arranged to provide a degree of lift to the kickboard 100. In some embodiments, the hydrofoil design may be configured to provide a neutral buoyancy characteristic to the kickboard 100. For instance, the kickboard 100 may be sized and shaped such that the kickboard 100 remains at the same position within the water regardless of the speed at which the kickboard 100 is being traversed through the water. The leading edge portion 154 of each wing portion 150, 152 may be curved from the lower surface 104 to the upper surface 102, thus facilitating fluid flow above or around the first and second wing portions 150, 152. In such embodiments, the lower surface 104 may be relative planar. In this manner, fluid passing above and below the kickboard 100 may travel at different speeds, such as the fluid passing over the top of the kickboard 100 traveling at a speed greater than the fluid passing under the kickboard 100, thus creating hydrodynamic lift.

Figure 7:
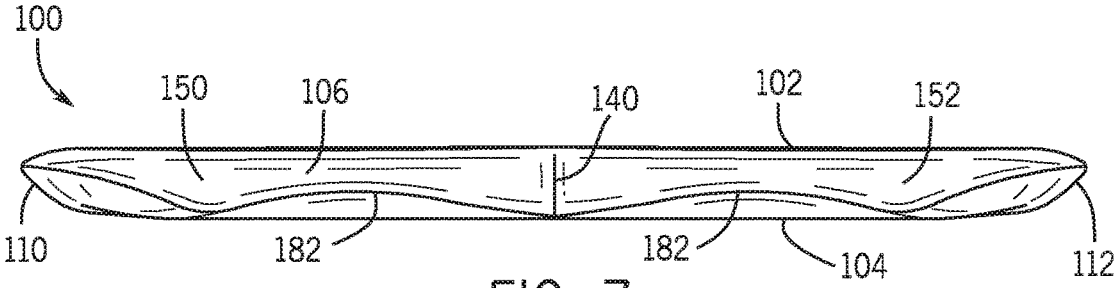
FIG. 7 is a front elevation view of the kickboard of FIG. 1.

In some embodiments, the first and second wing portions 150, 152 may be sized and shaped to provide a varying angle of attack. For example, the first and second wing portions 150, 152 may include an increased angle of attack adjacent the first peak 140. The angle of attack of each wing portion may decrease with distance away from the first peak 140. In such embodiments, the decreased angle of attack at the outermost portions of the first and second wing portions 150, 152 may permit some degree of rotation about the longitudinal centerline CL. Additionally or alternatively, the outermost portions of the first and second wing portions 150, 152 may include a reverse hydrofoil design to provide a neutral buoyancy of the kickboard 100. For instance, the reverse hydrofoil design may provide a downward pressure to the upper surface 102 to counterbalance or offset the upward pressure applied to the lower surface 104 of the kickboard 100 by the hydrofoil design adjacent the first peak 140. As shown in FIG. 7, the outermost portions of the first and second wing portions 150, 152 may curve upwardly to enhance the lateral stability of the kickboard 100 for finely-tuned control of the kickboard 100 by a user.

In addition or as an alternative to hydrofoil shaping, the kickboard 100 may rely on the buoyancy of its material to provide the necessary flotation, as explained below. As such, the kickboard 100 may be arranged to facilitate movement of the kickboard 100 either below, on, or above the surface of water. For example, the hydrofoil design and/or buoyancy characteristics of the kickboard 100 may permit the kickboard 100 to traverse just under the surface of the water to, for instance, reduce the tension on a user's shoulder, neck, and/or back regions and/or position the user in a more accurate or natural swimming position. For instance, the kickboard 100 may include a neutral buoyancy characteristic such that the kickboard 100 is submerged under the water surface with little to no downward pressure applied by a swimmer's hands or arms. As such, the kickboard 100 may be operable to increase the pelvic load and energy transfer of the user, reducing cervical, scapulohumeral, lumbar, and/or thoracic spine tension by lowering the angle of the arms and shoulders while raising the height of the hips and legs compared to the water surface. In this manner, the kickboard 100 may improve kick kinematics by placing a user in a position that more closely resembles the ideal swimming postures of the respective swimming strokes, including but not limited to freestyle, backstroke, breaststroke, and butterfly.

Figure 8:
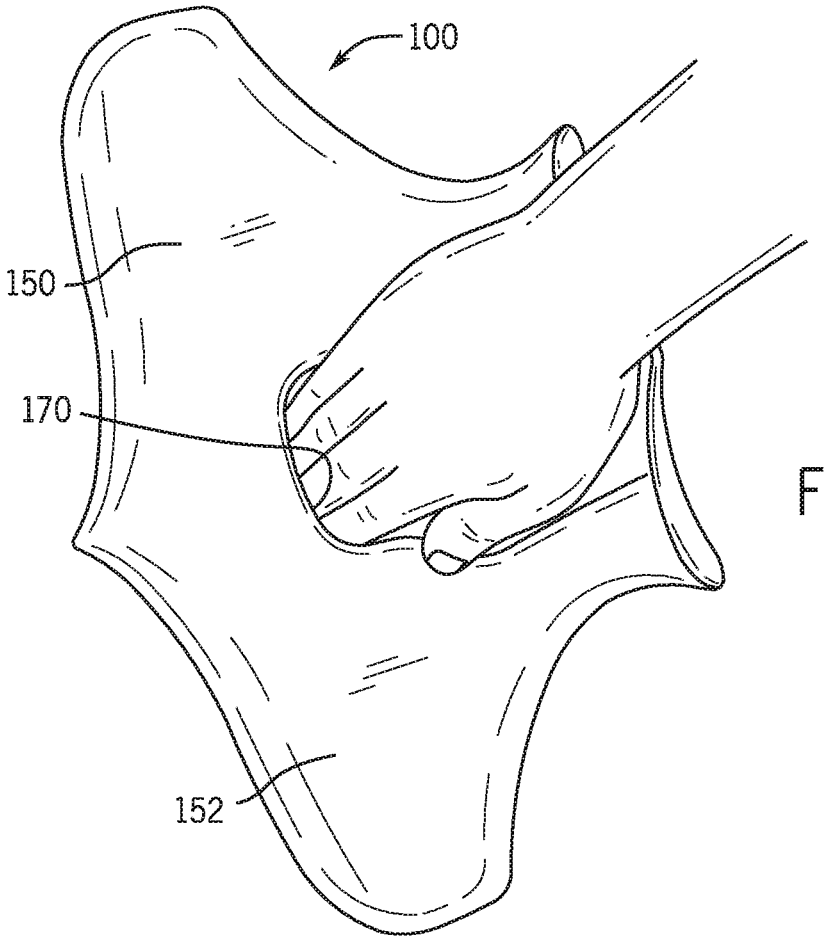
FIG. 8 is a perspective view of the kickboard of FIG. 1 engaged to a user.

Turning to FIGS. 1-6, the kickboard 100 may include one or more surface features to facilitate swim training. For instance, the kickboard 100 may include a channel 170 defined within the upper surface 102 at least partially between the front and rear edges 106, 108. As explained more fully below, the channel 170 may be arranged to receive at least a portion of a user's hand(s) during use. For instance, the user may position one or both hands at least partially within the channel 170 to control movement of the kickboard 100 during swim training exercises (see FIG. 8). In the embodiment of FIGS. 1, 2, and 4, the channel 170 extends from the rear edge 108 towards the front edge 106 along a portion of the longitudinal centerline CL. The channel 170, which may be centrally located within the upper surface 102, may include a length L and a width W (see FIG. 4). The length L, which is preferably less than the maximum length $L_{MAX}$ of the kickboard 100, may be between about 125 mm and about 185 mm (preferably about 155 mm). The width W, which is preferably less than the maximum width $W_{MAX}$ of the kickboard 100, may vary and may be between about 115 mm and about 145 mm (preferably about 130 mm). Like the maximum length $L_{MAX}$ and the maximum width $W_{MAX}$ of the kickboard 100, the length L and/or the width W of the channel 170 may be tailored to suit an adult or youth user. As shown, the channel 170 may be symmetrical across the longitudinal centerline CL. As such, the user may place either the left hand, the right hand, or both the left and right hands at least partially within the channel 170, such as in a stacked hand configuration. In this manner, the kickboard 100 may be used to promote proper form during swim training exercises.

In some embodiments, the channel 170 may include one or more features to facilitate engagement of the kickboard 100 with a user's hand(s). For example, a rib 172 may extend longitudinally within the channel 170, such as along the longitudinal centerline CL. The rib 172, which may define at least a portion of the second peak 142, may be size and shaped to fit a user's hand, such as a palm portion of a user's hand. A pair of side channels 174 may be defined in the upper surface 102 adjacent the channel 170. Each side channel 174 may be arranged to receive at least a portion of a user's thumb. The channel 170 may terminate at a cavity or pocket 176 defined adjacent the front edge 106. As best shown in FIG. 2, the pocket 176 may include a depth extending along a portion of the length between the front and rear edges 106, 108, such as towards the front edge 106 along the longitudinal centerline CL. In such embodiments, the pocket 176 may be defined between a bottom wall 178 defining the bottom of the channel 170 and a top wall 180 defined in the upper surface 102 of the kickboard 100. During operation, at least a portion of a user's finger(s) may be positioned within the pocket 176 (e.g., between the bottom and top walls 178, 180) to at least properly position the kickboard 100 on or about a user's hand(s) (see FIG. 8). As shown, the pocket 176 is defined within the kickboard 100 along or substantially adjacent its maximum width $W_{MAX}$. Depending on the particular application, the pocket 176 may be defined nearer the front or rear edges 106 or 108 such that the pocket 176 may be considered above or below the first and second wing portions 150, 152, respectively. In some embodiments, the pocket 176 may be arranged to enhance fingertip sensitivity and/or enhance user control of the kickboard 100. For instance, the bottom wall 178 within the pocket 176 may be relatively thin to allow a user to "feel" the water. In some embodiments, the pocket 176 may be positioned near the front edge 106 to allow a user to easily control the angle of attack of the front edge 106 and the first and second wing portions 150, 152. As such, the user may control the buoyancy effects of the kickboard 100 based on individual need and/or desires. Additionally or alternatively, the kickboard 100 may move with the user's hand(s) and/or arm(s) while the user performs various swimming movements (e.g., dolphin kicks, isolated arm motions and kickboard orientations, etc.).

The channel 170 and/or pocket 176 may be arranged to position a user in a more accurate or desired swim posture to promote proper form. For example, because the channel 170 and/or pocket 176 is positioned along the longitudinal centerline CL of the kickboard 100, a user may utilize the kickboard 100 using one hand to, for instance, permit the user to twist to breathe without the need to use a breathing apparatus. In addition, the kickboard 100 may distally support a user's arms while simultaneously permitting the user to move (e.g., twist or rotate, roll, pitch, yaw, etc.) while performing swim training exercises. Additionally or alternatively, when positioned within the channel 170 and/or pocket 176, a user's hand is positioned nearer the lower surface 104 of the kickboard 100, thus positioning the user in a more streamlined position.

Figure 3:
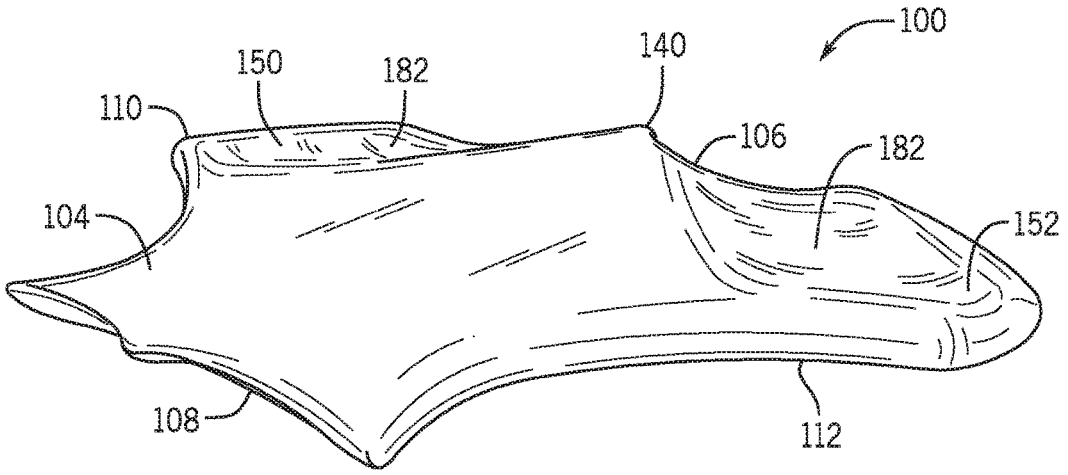
FIG. 3 is a bottom rear isometric view of the kickboard of FIG. 1.
Figure 5:
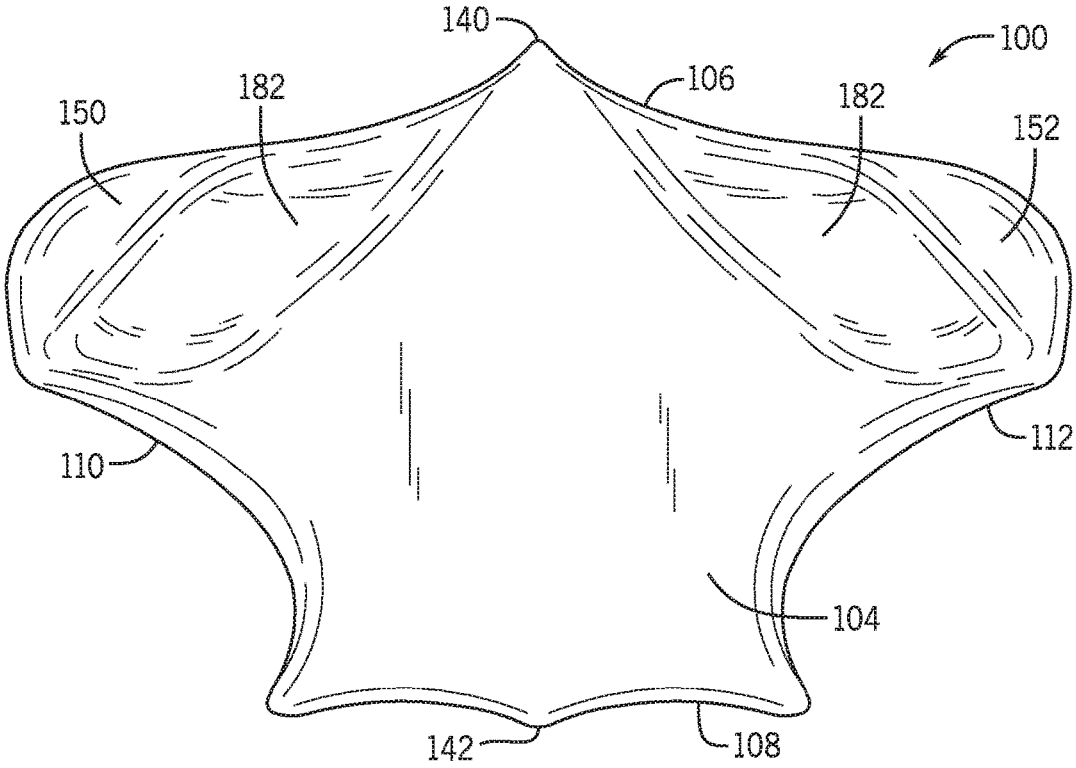
FIG. 5 is a bottom plan view of the kickboard of FIG. 1.
Figure 6:
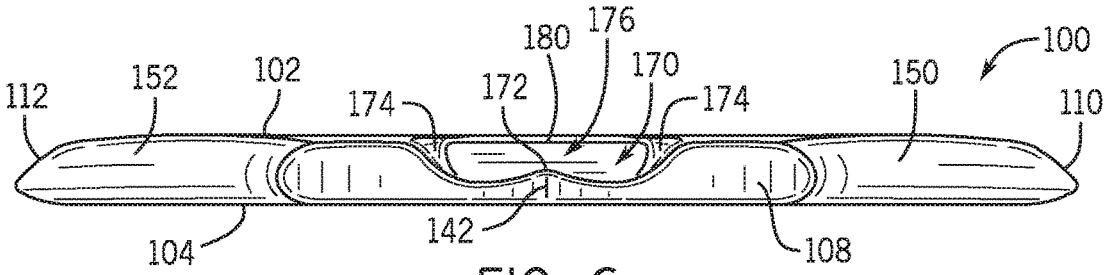
FIG. 6 is a rear elevation view of the kickboard of FIG. 1.

Referring to FIGS. 3 and 5, a plurality of grooves 182 (e.g., two grooves 182) may be defined in the lower surface 104 of the kickboard 100 to direct water flow across the underside of the kickboard 100, such as under the first and second wing portions 150, 152. The grooves 182, which may be referred to as water movement slots, may extend outwardly away from each other from adjacent the first peak 140 to the opposing left and right side edges 110, 112. In some embodiments, the grooves 182 may extend downwardly from the front edge 106 along a portion of the length of the kickboard 100. In some embodiments, each of the grooves 182 may be arranged to provide an aileron effect on the kickboard 100. For example, the shape of the grooves 182 may tilt the kickboard 100 forward as fluid flows across the grooves 182, thereby causing the kickboard 100 to, for example, level out during swim training. Because one or more grooves 182 are defined on each side of the longitudinal centerline CL, the grooves 182 may provide level flow along the lower surface 104 of the kickboard 100, which may stabilize the kickboard 100 laterally and limit rotation of the kickboard 100 about the longitudinal centerline CL.

Figure 9:
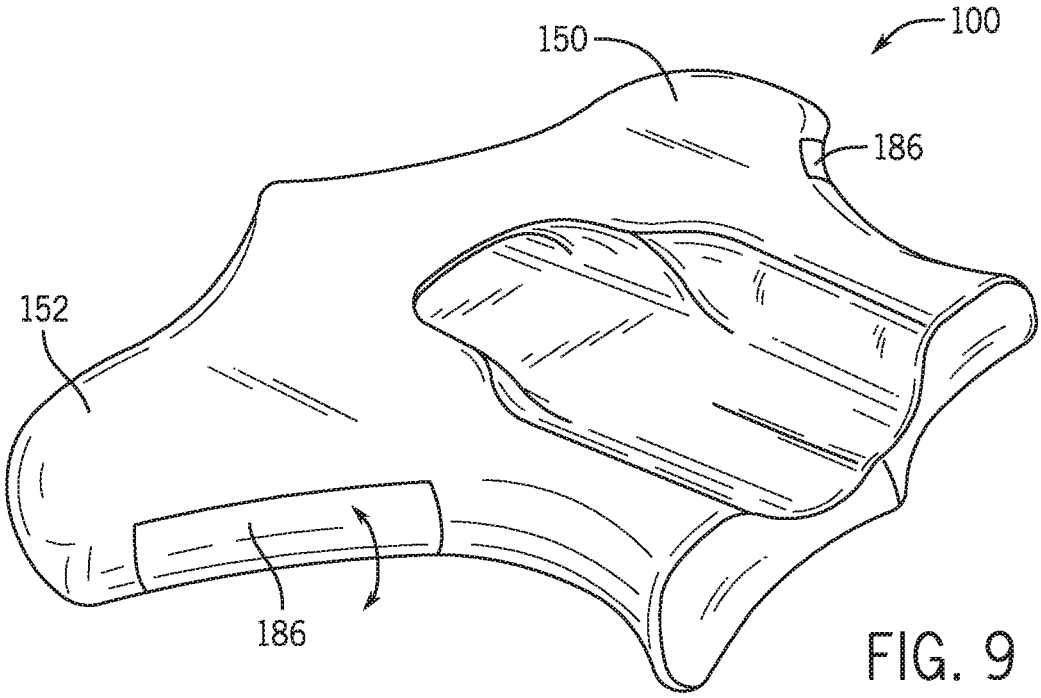
FIG. 9 is perspective view of an additional kickboard including one or more ailerons to adjust the flotation characteristic of the kickboard.
Figure 10:
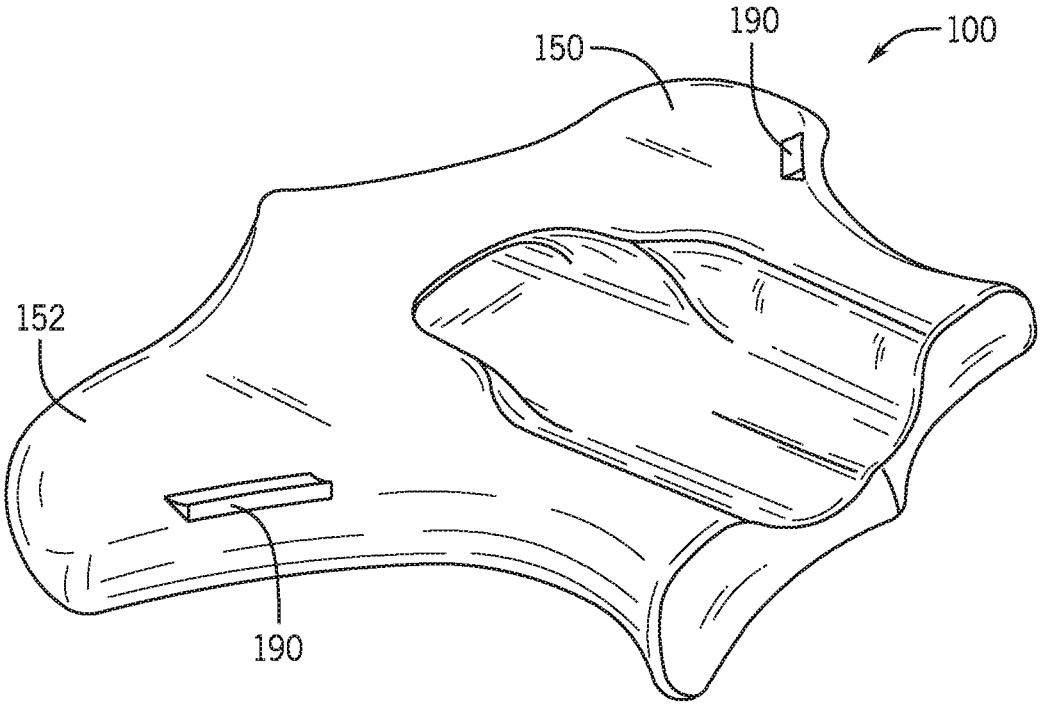
FIG. 10 is a perspective view of an additional kickboard including one or more trim tabs to adjust the flotation characteristic of the kickboard.

Turning to FIGS. 9 and 10, the kickboard 100 may include other features for convenience. For example, in some embodiments, the kickboard 100 may be adjustable to accommodate users of different swimming abilities. In one embodiment, portions of the kickboard 100 may articulate to alter the degree of flotation (i.e., lift) provided by the kickboard 100. For instance, at least portions of the first and second wing portions 150, 152, such as ailerons 186, may articulate relative the body of the kickboard 100, such as tilting forward or aft or moving towards or away from the first and second wing portions 150, 152, to reduce or increase the amount of lift and/or lateral stability provided by the kickboard 100. For example, moving the ailerons 186 towards or away from the first and second wing portions 150, 152 may reduce or increase the lateral stability of the kickboard 100 by, for example, respectively decreasing or increasing the effective size of the wing portions 150, 152. Similarly, lengthening or shortening the ailerons 186 may respectively increase or decrease the amount of lift provided by the kickboard 100. Rotating the ailerons 186 upwardly away from the lower surface 104 may trim the front of the kickboard 100 upwardly. Rotating the ailerons 186 downwardly away from the upper surface 102 may have a similar effect on the kickboard 100, such as trimming the front of the kickboard 100 downwardly.

Additionally or alternatively, elements may be selectively added to the kickboard 100 to customize the flotation characteristics of the kickboard 100. For example, one or more trim tabs 190 may be coupled to the kickboard 100, such as to the first and second wing portions 150, 152, to provide additional trim adjustment for the kickboard 100. The additional trim tabs 190 may alter the angle of attack of the kickboard 100 under and/or on the surface of the water. In some embodiments, the one or more ailerons 186 and/or the trim tabs 190 may increase or decrease drag of the kickboard 100 to respectively increase or decrease swim training resistance to suit the particular needs and/or desires of a swim training program.

In some embodiments, the kickboard 100 may be arranged to provide training feedback to a user, such as indicating to the user improvement, if any, in swim form and/or performance. In some embodiments, the kickboard 100 may be configured to indicate to the user that a desired swim characteristic has been achieved, such as a desired speed and/or orientation within the water, among others. For example, the kickboard 100 may include one or more sensors configured to detect the arrangement, position, speed, and/or utilization of the kickboard 100 during use. The sensor(s) may provide feedback to the user via audible, visual and/or tactile cues. Additionally or alternatively, the sensor(s) may transmit its gathered data to a data storage component (e.g., a computer memory, a portable storage device, or the like) via a hardwired or wireless connection for real time and/or after training analysis by computer software, the user, and/or a swim training coach. The gathered data may be useful in tracking swim improvement of a user and/or the efficacy of a particular swim training program.

The kickboard 100 may be formed from a variety of materials and means. For instance, the kickboard 100 may be formed from a buoyant material, such as ethylene-vinyl acetate (EVA), foam, plastic, injection or compression molded rubber, or any other material promoting floatation. The kickboard 100 may be formed in any suitable manner, such as by molding, extrusion, milling, die cutting, or the like. In some embodiments, at least a portion of the kickboard 100 may be coated with a vinyl, a rubberized material, or any other coating for increased durability and/or waterproofing. The material may be selected for a desired varied buoyancy of the kickboard 100. For example, the kickboard 100 may be formed from a material that allows the kickboard 100 to float at a desired position relative the surface of the water (e.g., on the surface of the water, just under the surface of the water, a few centimeters below the surface of the water, pitched, yawed, rolled, or the like), either unweighted or while loaded by a user during swim training.

In some embodiments, portions of the kickboard 100 may be formed from materials of different buoyancy characteristics. For example, the front portion of the kickboard 100 may be formed from a first material, and the rear portion of the kickboard 100 may be formed from a second material. The first and second materials may be configured such that the front portion is more or less buoyant than the rear portion. Similarly, the portion of the kickboard 100 along the longitudinal centerline CL may be more or less buoyant than the first and second wing portions 150, 152 due to the difference in cross sectional thickness and/or material selection. In this way, the flotation characteristics may be customized depending on the particular application to, for instance, provide a desired load transfer between the kickboard 100 and a user.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed:

1. A kickboard comprising:

an upper surface;

a lower surface;

front, rear, left, and right edges bounding the upper and lower surfaces; and a channel defined within the upper surface at least partially between the front and rear edges;

wherein the left and right edges undulate between the front and rear edges to define first and second wing portions nearer the front edge than the rear edge;

wherein a trailing edge portion of the first and second wing portions taper toward each other to adjacent the rear edge; and wherein a distance between the trailing edge portions of the first and second wing portions increases to the rear edge.

2. The kickboard of claim 1, wherein the lower surface includes a plurality of grooves defined therein and extending from the front edge.

3. The kickboard of claim 2, wherein each of the plurality of grooves extends from the front edge to one of the left and right edges.

4. The kickboard of claim 1, wherein each of the front, rear, left, and right edges includes a concave edge portion.

5. The kickboard of claim 4, wherein each of the front and rear edges includes a plurality of concave edge portions.

6. The kickboard of claim 1, wherein the rear edge is angled towards the front edge between the upper and lower surfaces.

7. A kickboard comprising:

opposing front and rear edges;

a longitudinal centerline extending between the front and rear edges; and first and second wing portions positioned opposite each other across the longitudinal centerline and positioned nearer the front edge than the rear edge, each of the first and second wing portions defining a convex leading edge portion and a concave trailing edge portion;

wherein the trailing edge portions of the first and second wing portions taper toward each other to adjacent the rear edge; and wherein the distance between the trailing edge portions of the first and second wing portions increases to the rear edge.

8. The kickboard of claim 7, wherein each of the first and second wing portions includes a hydrofoil design arranged to provide lift to the kickboard.

9. The kickboard of claim 7, wherein the first and second wing portions define the width of the kickboard.

10. The kickboard of claim 9, wherein the first and second wing portions define a maximum width of the kickboard within a front portion of the kickboard.

11. The kickboard of claim 10, wherein the maximum width of the kickboard is nearer the front edge than the rear edge.

12. The kickboard of claim 7, further comprising:

a first peak defined in the front edge and positioned at the longitudinal centerline; and a second peak defined in the rear edge and positioned at the longitudinal centerline, the first and second peaks extending away from each other.

13. A kickboard configured to traverse under the surface of water, the kickboard comprising:

opposing upper and lower surfaces and opposing front and rear edges;

a plurality of wings each including a hydrofoil design to provide a degree of hydrodynamic lift to the kickboard while traversing through water, the plurality of wings positioned nearer the front edge than the rear edge; and one or more surface elements associated with at least one of the upper and lower surfaces, the one or more surface elements arranged to define a flotation characteristic of the kickboard;

wherein the one or more surface elements comprises at least one of a channel defined in the upper surface, a plurality of grooves defined laterally in the lower surface, and one or more ailerons coupled to the kickboard; and wherein each of the plurality of grooves provides an aileron effect on the kickboard to trim the kickboard during swim training.

14. The kickboard of claim 13, wherein the channel is defined along a longitudinal centerline extending between front and rear edges of the kickboard.

15. The kickboard of claim 14, wherein the channel terminates at a pocket including a depth extending along the longitudinal centerline.

16. The kickboard of claim 13, wherein the one or more ailerons are adjustable.

* * * * *